US009435153B2

(12) United States Patent
Chen

(10) Patent No.: US 9,435,153 B2
(45) Date of Patent: Sep. 6, 2016

(54) CURTAIN BODY LOCATING MECHANISM OF A CURTAIN WITH NO CORD

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 40 days.

(21) Appl. No.: 14/617,265

(22) Filed: Feb. 9, 2015

(65) Prior Publication Data

US 2016/0230453 A1 Aug. 11, 2016

(51) Int. Cl.
*E06B 9/322* (2006.01)

(52) U.S. Cl.
CPC ..... *E06B 9/322* (2013.01); *E06B 2009/3222* (2013.01)

(58) Field of Classification Search
CPC ..... E06B 9/322; E06B 2009/322; E06B 2009/3222
See application file for complete search history.

(56) References Cited

U.S. PATENT DOCUMENTS

| | | | | |
|---|---|---|---|---|
| 6,675,861 | B2 * | 1/2004 | Palmer | E06B 9/322 160/170 |
| 7,025,107 | B2 * | 4/2006 | Ciuca | E06B 9/322 160/170 |
| 2015/0136336 | A1 * | 5/2015 | Huang | E06B 9/322 160/170 |
| 2015/0275573 | A1 * | 10/2015 | Huang | E06B 9/322 160/192 |
| 2016/0123073 | A1 * | 5/2016 | Chen | E06B 9/34 160/170 |

* cited by examiner

*Primary Examiner* — Blair M Johnson
(74) *Attorney, Agent, or Firm* — Muncy, Geissler, Olds & Lowe, P.C.

(57) ABSTRACT

A curtain body locating mechanism for use in a curtain with no cord comprises a fixed base, two first driving wheels, two second driving wheels, two movable shafts and two resistance wheels. The first driving wheels are disposed on the fixed base and connected together by a coil spring, and the second driving wheels are disposed on the fixed base and engaged with the first driving wheels. Each of two driving ropes is connected to each of the second driving wheels, and the two movable shafts are disposed on the fixed base movably in the horizontal direction and are connected together by a tension spring. The resistance wheel is nested onto the movable shaft rotatably and is surrounded by one of the driving ropes.

5 Claims, 6 Drawing Sheets

CURTAIN BODY LOCATING MECHANISM OF A CURTAIN WITH NO CORD

BACKGROUND OF THE INVENTION

1. Technical Field

The present invention relates to a curtain with no cord, and more particularly, to a curtain body locating mechanism for use in a curtain with no cord.

2. Description of Related Art

Generally, curtains can be divided structurally into curtains with cord and curtains with no cord. For the curtains with cord, a user mainly utilizes a cord to drive the curtain body to be spread or folded; and for the curtains with no cord, the user uses his/her hand to pull down or push up a lower beam so as to spread or fold the curtain body.

For conventional technologies of curtains with no cord, a one-way tension mechanism is utilized to control actions of a first cord and a second cord, as shown in U.S. Pat. No. 7,025,107. When a curtain is being spread, the one-way tension mechanism is driven by the first cord and the second cord to be disconnected, and in this case, the first cord and the second cord can move freely. Once the user has stopped spreading the curtain, the one-way tension mechanism is driven by the first cord and the second cord to be connected, and in this case, the first cord and the second cord will not be winded up by a actuator so that the curtain is located. However, in this conventional patent application, because the actuator and the one-way tension mechanism are disposed in a top rail individually, not only the complexity of the overall structure will be increased, but the assembling process will also be troublesome due to the limited space in the top rail.

BRIEF SUMMARY OF THE INVENTION

A primary objective of the present invention is to provide a curtain body locating mechanism for use in a curtain with no cord which has a simplified structure and a better locating effect so as to make the operation more convenient.

To achieve the aforesaid objective, the curtain body locating mechanism of the present invention comprises a fixed base, two first driving wheels, a coil spring, two second driving wheels, two driving ropes and a resistance unit. An upper guide groove and a lower guide groove are disposed at two ends of the fixed base respectively, wherein the upper guide groove and the lower guide groove correspond with each other. The two first driving wheels are disposed on the fixed base rotatably and engaged with each other. The coil spring is connected to the two first driving wheels and optionally winded onto one of the two first driving wheels through the rotation of the two first driving wheels. The two second driving wheels are disposed on the fixed base rotatably and engaged with the two first driving wheels respectively so that the first driving wheels and the second driving wheels can rotate simultaneously. One end of each of the two driving ropes is connected to one of the second driving wheels so that the second driving wheel can be driven to rotate when a pulling force is applied to the driving rope; and moreover, the driving rope can be winded onto the second driving wheel when the second driving wheel is driven by the first driving wheel. The resistance unit has two movable shafts, a tension spring, two stoppers and two resistance wheels. The upper and the bottom ends of each of the movable shafts are inserted movably into the upper guide groove and the lower guide groove of the fixed base respectively. The tension spring is connected to the two moveable shafts so as to pull the two movable shafts towards the second driving wheels. Each of the two stoppers is disposed on the fixed base and located between the second driving wheel and the moveable shaft. Each of the resistance wheels is rotatably nested onto one of the movable shafts and is winded around by one of the driving ropes so that each of the resistance wheels can be separated from the stopper by the pulling force of the driving rope and clamped to the stopper through the elastic restoring force of the tension spring. In this way, good locating effect can be provided when the curtain body is being spread or folded.

Preferably, the upper and the lower ends of each of the movable shafts comprise an upper guide block and a lower guide block respectively, and the upper guide block and the lower guide block are inserted into the upper guide groove and the lower guide groove of the fixed base respectively. The lengths of the upper guide block and the lower guide block are smaller than the lengths of the upper guide groove and the lower guide groove so that the movable shaft can be assembled to the fixed base movably.

Preferably, the stopper is a rod, and each of the resistance wheels has an upper fluted disc and a lower fluted disc. When the elastic restoring force of the tension spring is applied to each of the resistance wheels, the resistance wheel can be clamped to the stopper through the upper fluted disc and the lower fluted disc so that each of the resistance wheels stops rotating and a frictional resistance is generated between the resistance wheel and the driving rope.

DETAILED DESCRIPTION OF THE INVENTION

Figure 1:
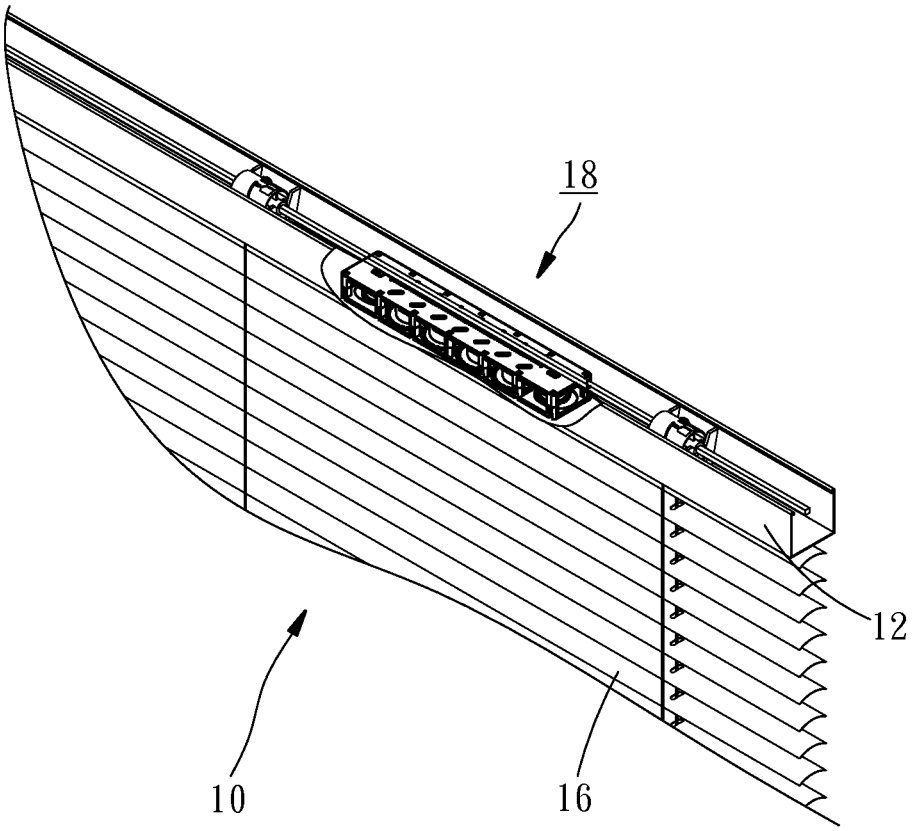
FIG. 1 is a combined perspective view of the present invention.
Figure 5:
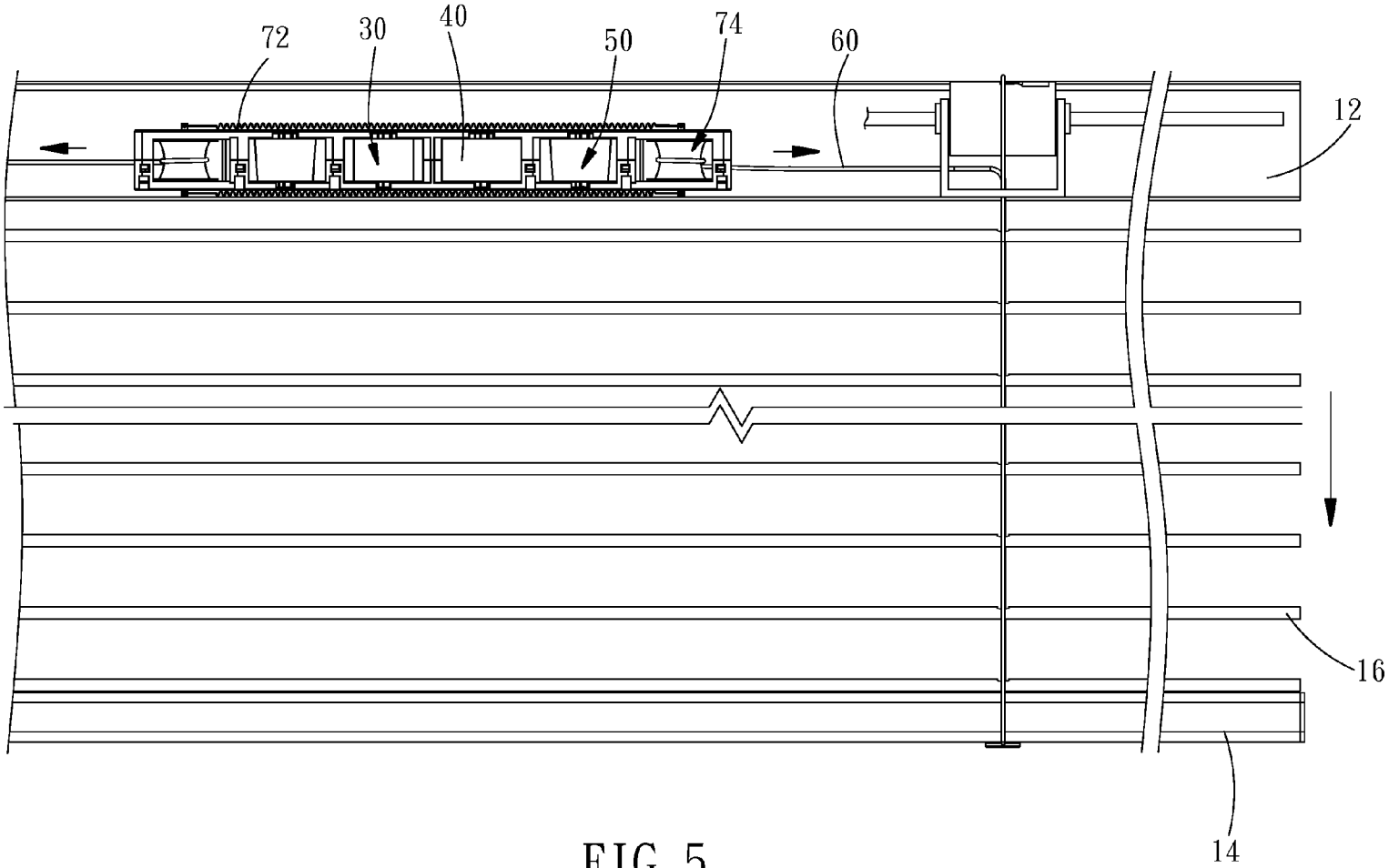
FIG. 5 is a front view of the present invention when a curtain body is spread.

Referring to FIG. 1 and FIG. 5 firstly, a curtain 10 with no cord shown in the figures comprises an upper beam 12, a lower beam 14 opposite to the upper beam 12, and a curtain body 16 disposed between the upper beam 12 and the lower beam 14. Next referring to FIG. 2, a curtain body locating mechanism 18 of the present invention comprises a fixed base 20, two first driving wheels 30, a coil spring 40, two second driving wheels 50, two driving ropes 60 and a resistance unit 70.

The fixed base 20 is installed within the upper beam 12. The fixed base 20 comprises an upper fixed plate 21 and a lower fixed plate 25 which are assembled together symmetrically in a vertical direction. Four upper fixing pillars 22 are arranged at the bottom side of the upper fixed plate 21 at regular intervals. Each of the two ends of the upper fixed plate 21 has an upper guide groove 23 and an upper fixing hole 24 adjacent to the upper guide groove 23, and the upper guide groove 23 extends along the length direction of the upper fixed plate 21. Four lower fixing pillars 26 are arranged at the top side of the lower fixed plate 25 at regular intervals, and the top end of the lower fixing pillar 26 and the bottom end of the upper fixing pillar 22 of the upper fixed plate 21 are connected together by means of insertion. Each of the two ends of the lower fixed plate 25 has a lower guide groove 27 and a lower fixing hole 28 adjacent to the lower guide groove 27, and the lower guide groove 27 extends along the length direction of the lower fixed plate 25 and corresponds to the upper guide groove 23 of the upper fixed plate 21. The lower fixing hole 28 corresponds to the upper fixing hole 24 of the upper fixed plate 21.

Each of the first driving wheels 30 comprises two first driving fluted discs 31 and a first driving axle 32 connected between the two first driving fluted discs 31. During the assembling, the first driving axle 32 is nested onto one upper fixing pillar 22 and one lower fixing pillar 26 of the fixed base 20. After the assembling is finished, the first driving fluted discs 31 of the two first driving wheels 30 are engaged together so that the two first driving wheels 30 can rotate simultaneously.

Two ends of the coil spring 40 are connected to the first driving axles 32 of the first driving wheels 30 respectively so that the coil spring 40 can be winded onto the first driving axle 32 of one of the first driving wheels 30 through the rotation of the two first driving wheels 30.

Each of the second driving wheels 50 comprises two second driving fluted discs 51 and a second driving axle 52 connected between the two second driving fluted discs 51. During the assembling, the second driving axle 52 is nested onto another upper fixing pillar 22 and another lower fixing pillar 26 of the fixed base 20. After the assembling is finished, the second driving fluted discs 51 of the second driving wheels 50 are engaged with the first driving fluted discs 31 of the first driving wheels 30 so that the first driving wheels 30 and the second driving wheels 50 can rotate simultaneously.

One end of the driving rope 60 is fixed to the second driving axle 52 of the second driving wheel 50, and the other end of the driving rope 60 passes through the curtain body 16 and is fixed to the lower beam 14.

Figure 2:
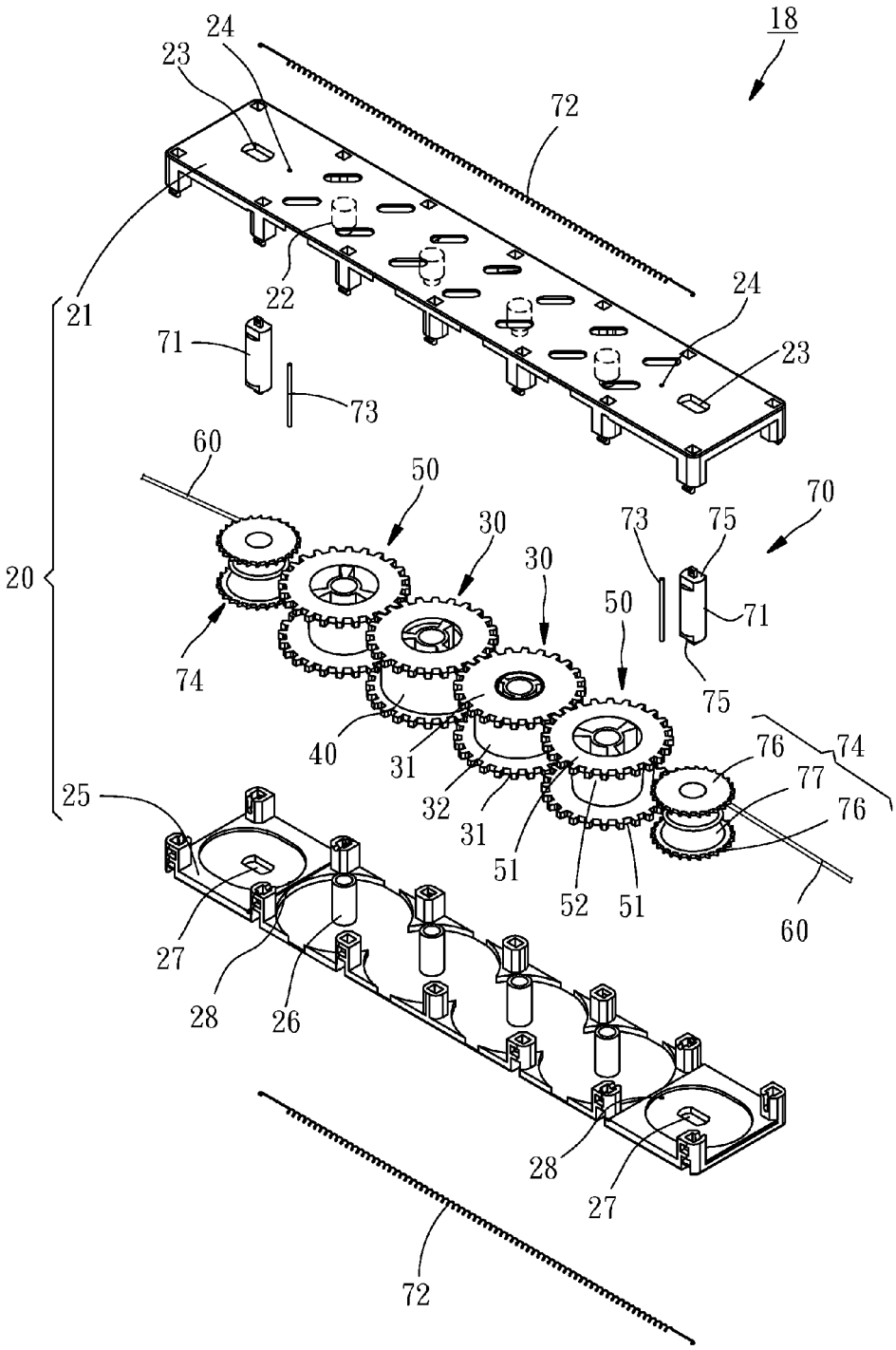
FIG. 2 is an exploded perspective view of the present invention.
Figure 3:
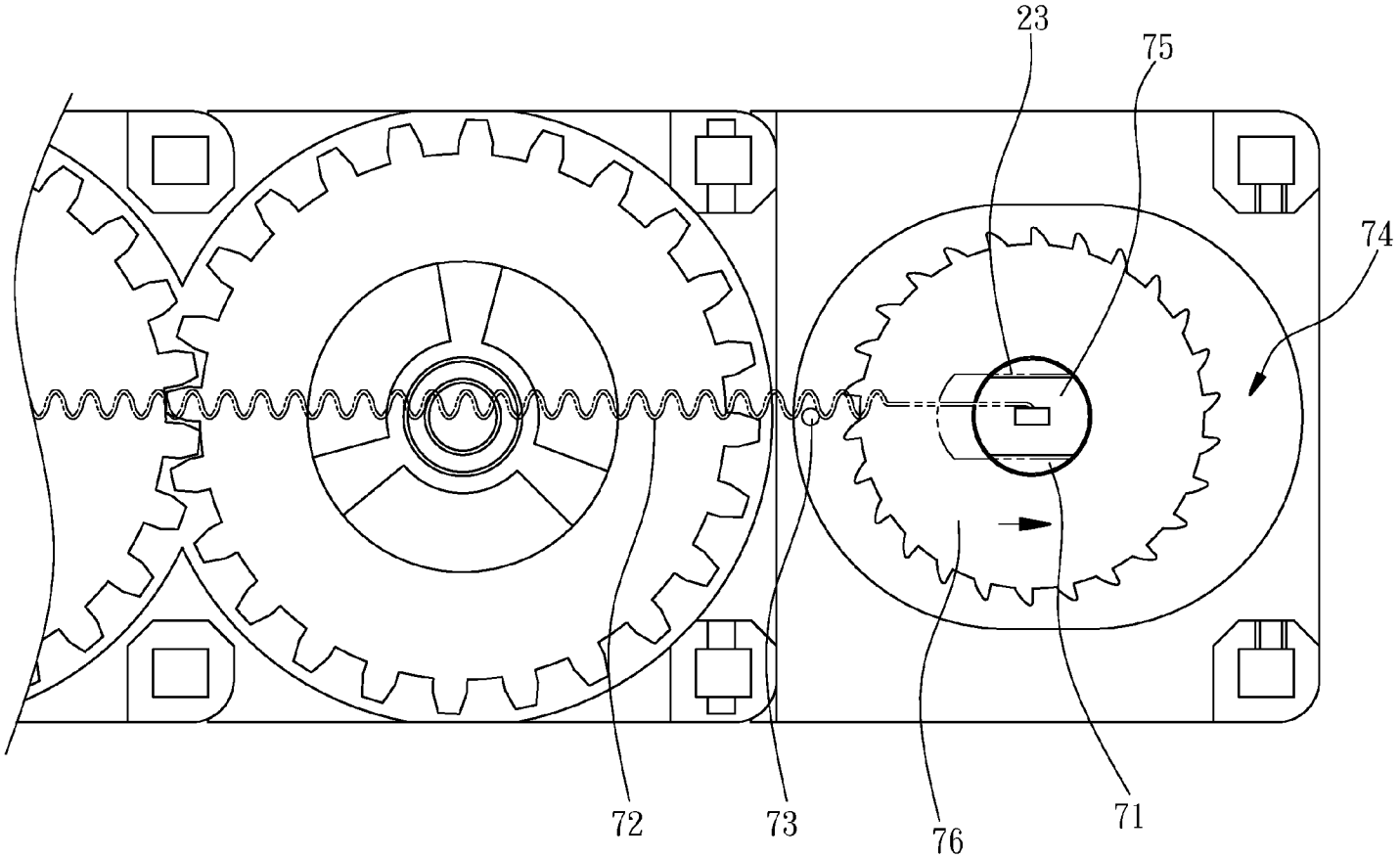
FIG. 3 is a partial top view of the present invention and mainly shows a state where a resistance wheel is separated from a stopper.
Figure 4:
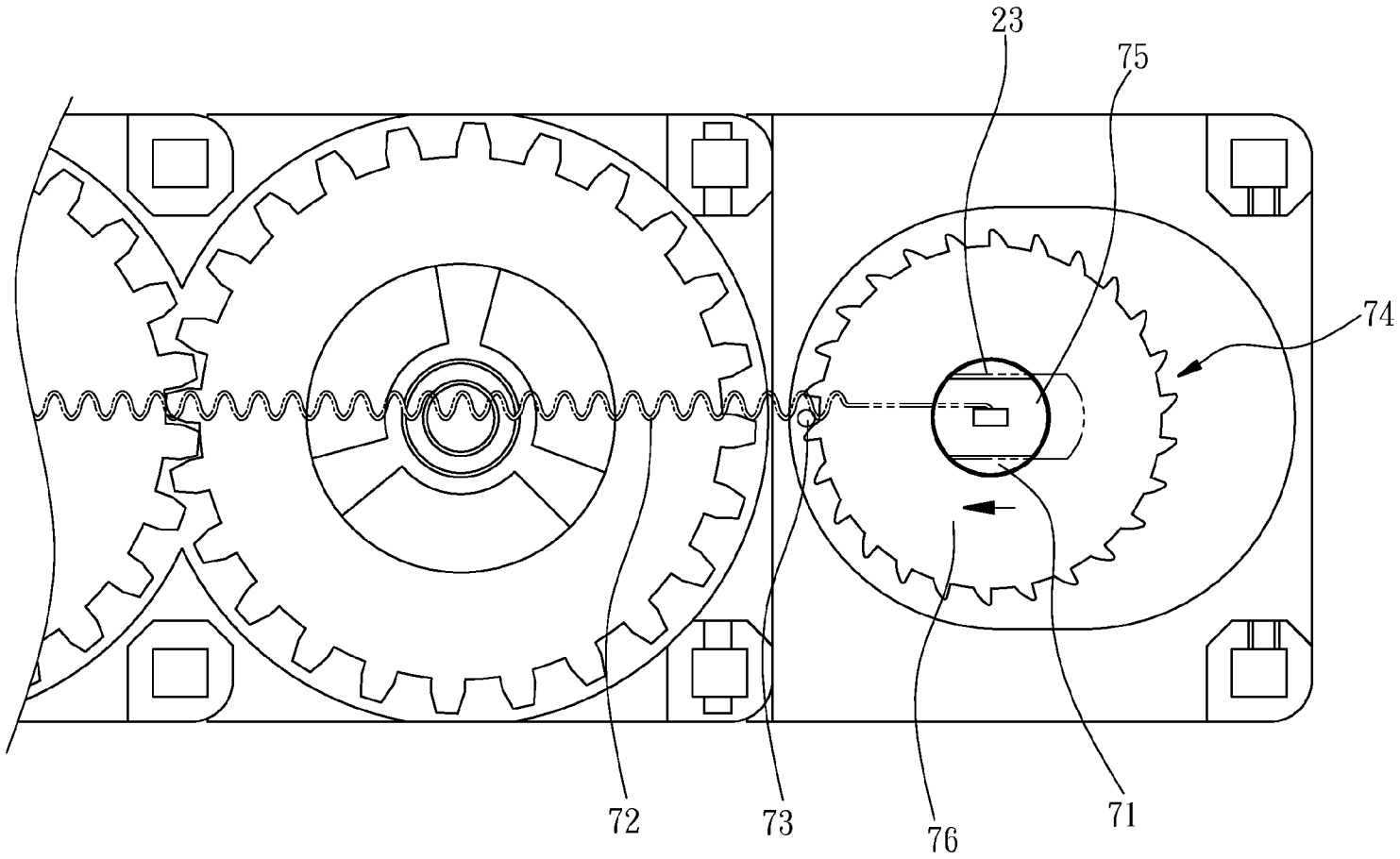
FIG. 4 is a partial top view of the present invention and mainly shows a state where the resistance wheel is clamped to the stopper.

The resistance unit 70 has two movable shafts 71, two tension springs 72, two stoppers 73 and two resistance wheels 74, as shown in FIG. 2 to FIG. 4. Each of the upper and the lower ends of the movable shaft 71 comprises a guide block 75, and the moveable shaft 71 is inserted into the upper guide groove 23 and the lower guide groove 27 of the fixed base 20 through the guide blocks 75. Because the lengths of the guide blocks 75 is smaller than the lengths of the upper guide groove 23 and the lower guide groove 27, the moveable shaft 71 can move along the upper guide groove 23 and the lower guide groove 27 of the fixed base 20. Each of the two tension springs 72 is connected between the guide blocks 75 of the two movable shafts 71 so as to pull the movable shafts 71 towards the second driving wheels 50. Here, the stopper 73 is exemplified as a rod. During the assembling, the top and the bottom ends of the stopper 73 are inserted and fixed into the upper fixing hole 24 and the lower fixing hole 28 of the fixed base 20 respectively. After the assembling is finished, the stopper 73 will be located between the second driving wheel 50 and the movable shaft 71. The resistance wheel 74 comprises two resistance fluted discs 76 and a resistance axle 77 connected between the two resistance fluted discs 76. During the assembling, the resistance axle 77 of the resistance wheel 74 is nested onto the movable shaft 71 and winded around by the driving rope 60 so that, on the one hand, the resistance fluted discs 76 of the resistance wheel 74 can be separated from the stopper 73 by the pulling force of the driving rope 60 and, on the other hand, the resistance fluted discs 76 of the resistance wheel 74 can be clamped to the stopper 73 through the elastic restoring force of the tension spring 72 applied to the movable shaft 71.

When a user needs to spread the curtain body 16, as shown in FIG. 5, he/she firstly applies a force to pull down the lower beam 14 so that each of the driving ropes 60 is stretched by the lower beam 14. When the driving rope 60 is stretched by the lower beam 14, the second driving wheel 50 will be driven to rotate which in turn drives the first driving wheel 30 to rotate so that the coil spring 40 is unwound from one first driving wheel 30 and winded onto the other first driving wheel 30 to accumulate the elastic restoring force thereof. On the other hand, when the driving rope 60 is stretched, the resistance wheel 74 will be driven simultaneously so as to drive the movable shaft 71 to move away from the second driving wheel 50. Once the guide blocks 75 of the movable shaft 71 have reached the outer end of the upper guide groove 23 and the lower guide groove 27 of the fixed base 20, as shown in FIG. 3, the resistance fluted discs 76 of the resistance wheel 74 will be separated from the stopper 73 so that the resistance wheel 74 can be driven by the driving rope 60 to rotate around the movable shaft 71. Meanwhile, the tension spring 72 will also be stretched by the guide blocks 75 of the movable shaft 71 to accumulate the elastic restoring force thereof. When the pulling force applied to the lower beam 14 is released after the curtain body 16 has been spread to a predetermined position, the tension spring 72 will pull the movable shafts 71 through the elastic restoring force thereof so that the resistance wheels 74 move towards the second driving wheels 50 together with the movable shafts 71. Once the guide blocks 75 of the movable shaft 71 have reached the inner end of the upper guide groove 23 and the lower guide groove 27 of the fixed base 20, as shown in FIG. 4, the resistance fluted discs 76 of the resistance wheel 74 will be clamped to the stopper 73. As such, the resistance wheel 74 will stop rotating. In this case, the elastic restoring force of the coil spring 40 is offset by the frictional resistance between the driving rope 60 and the resistance wheel 74 so that the curtain body 16 can remain spread stably.

Figure 6:
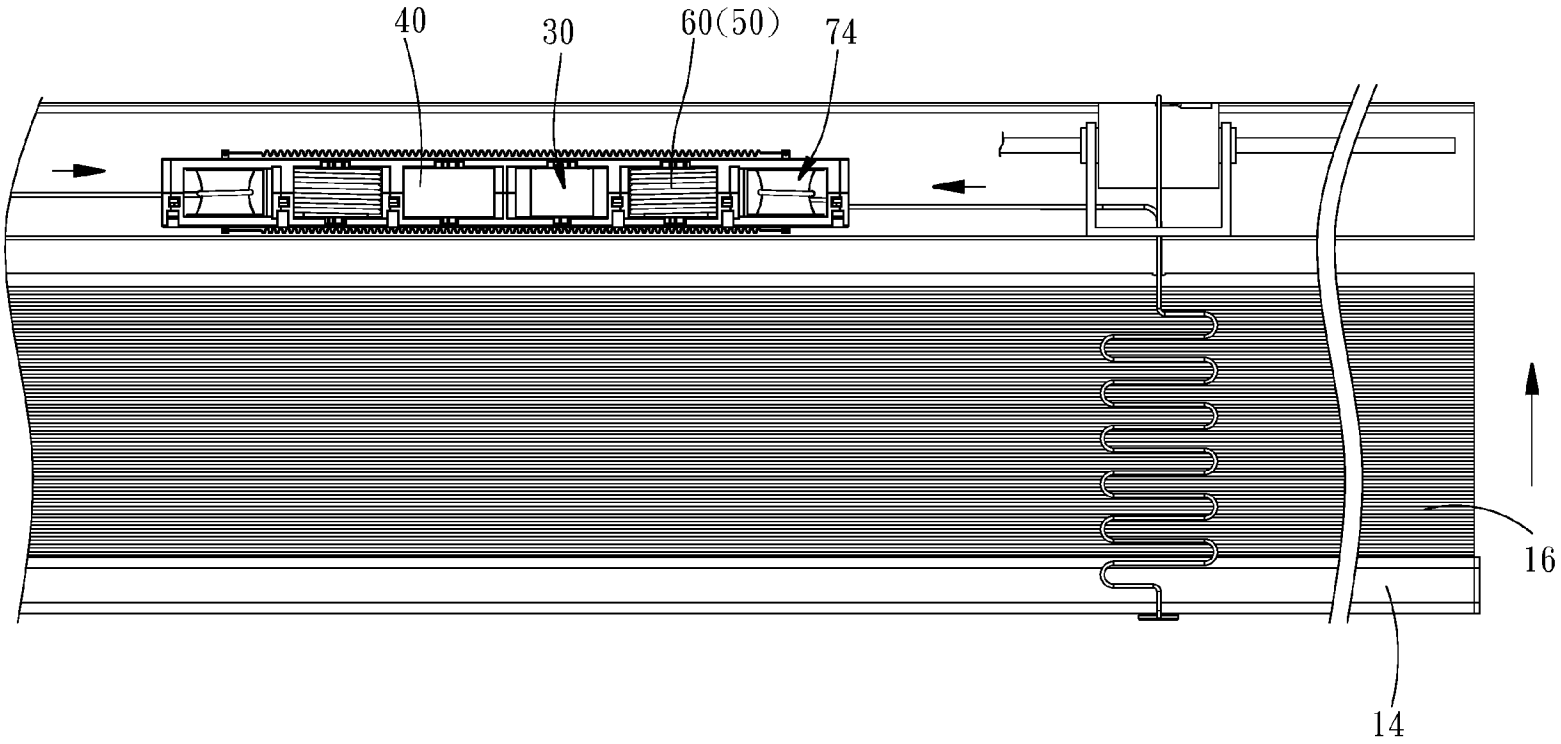
FIG. 6 is a front view of the present invention when the curtain body is folded.

When the user needs to fold the curtain body 16, as shown in FIG. 6, he/she firstly applies a force to push the lower beam 14 up so that the driving rope 60 is loosed to reduce the frictional resistance between the driving rope 60 and the resistance wheel 74. In this case, the elastic restoring force of the coil spring 40 forces the two first driving wheels 30 to rotate in opposite directions simultaneously with the aid of the pushing force of the user, and the rotation of the first driving wheels 30 will in turn drive the second driving wheels 50 to rotate so as to wind the driving ropes 60 onto the second driving wheels 50. When the driving ropes 60 are winded up, the resistance wheels 74 are clamped to the stoppers 73 through the pulling force applied to the movable shafts 71 by the tension spring 72, i.e., the resistance wheels 74 will stop rotating and remain still. After the curtain body 16 is completely folded together, the pushing force applied to the lower beam 14 is released so that the driving rope 60 is winded tightly onto the resistance wheel 74 again. In this case, the elastic restoring force of the coil spring 40 is offset by the frictional resistance between the driving rope 60 and the resistance wheel 74 so that the curtain body 16 can remain folded stably.

According to the above description, the curtain body locating mechanism 18 of the present invention mainly integrates the first driving wheels 30 and the second driving wheels 50 for winding up the driving ropes 60 with the resistance wheels 74 for controlling actions of the driving ropes 60. As compared to the conventional technologies, the structure is simplified effectively and the assembling complexity is reduced. Moreover, during the operation, the good locating effect is provided by the frictional resistance generated between the driving ropes 60 and the resistance wheels 74 together with the clamping relationships between the resistance wheels 74 and the stoppers 73. In this way, the curtain body 16 can be prevented from rising again after being spread or sagging after being folded so as to make the operation more convenient.

What is claimed is:

1. A curtain body locating mechanism for use in a curtain with no cord, comprising:

a fixed base with an upper guide groove and a lower guide groove disposed at two ends thereof respectively, wherein the upper guide groove and the lower guide groove on each end correspond with each other;

two first driving wheels disposed on the fixed base rotatably and engaged with each other;

a coil spring configured to connect the two first driving wheels and optionally winded onto one of the two first driving wheels;

two second driving wheels disposed on the fixed base rotatably and engaged with the two first driving wheels respectively;

two driving ropes, one end of each of the two driving ropes being connected to a respective one of the second driving wheels; and a resistance unit having two movable shafts, at least one tension spring, two stoppers and two resistance wheels, wherein upper and the bottom ends of each of the movable shafts are inserted movably into the respective upper guide groove and the lower guide groove at each end of the fixed base respectively, the tension spring is connected to the two moveable shafts, each of the two stoppers is disposed on the fixed base and located between one of the second driving wheels and one of the moveable shafts, respectively, each of the resistance wheels is rotatably nested on a respective one of the movable shafts and is winded around by one of the driving ropes so that each of the resistance wheels can be separated from the stopper by the pulling force of the driving rope and clamped to the stopper through the elastic restoring force of the tension spring.

2. The curtain body locating mechanism for use in a curtain with no cord of claim 1, wherein each of the upper and the lower ends of each of the movable shafts comprise a guide block respectively, the two guide blocks are inserted into the upper guide groove and the lower guide groove of the fixed base respectively, and the length of each of the guide blocks is smaller than the lengths of the upper guide groove and the lower guide groove.

3. The curtain body locating mechanism for use in a curtain with no cord of claim 2, wherein there are two tension springs, and each of the two tension springs is connected between the guide blocks of each of the two movable shafts respectively.

4. The curtain body locating mechanism for use in a curtain with no cord of claim 1, wherein the stopper is a rod, each of the resistance wheels has two resistance fluted discs and a resistance axle connecting the two resistance fluted discs, the two resistance fluted discs are clamped to the stopper separably, and the resistance axle is surrounded by one of the driving ropes.

5. The curtain body locating mechanism for use in a curtain with no cord of claim 4, wherein an upper fixing hole and a lower fixing hole corresponding with each other are disposed at two ends of the fixed base respectively, and the upper end and the lower end of the stopper are inserted and fixed into the upper fixing hole and the lower fixing hole respectively.

* * * * *